US010315092B2

(12) United States Patent
Chen

(10) Patent No.: US 10,315,092 B2
(45) Date of Patent: Jun. 11, 2019

(54) STRIKING TRAINING DEVICE

(71) Applicant: Yi-Lin Chen, Taichung (TW)

(72) Inventor: Yi-Lin Chen, Taichung (TW)

( * ) Notice: Subject to any disclaimer, the term of this patent is extended or adjusted under 35 U.S.C. 154(b) by 328 days.

(21) Appl. No.: 15/175,619

(22) Filed: Jun. 7, 2016

(65) Prior Publication Data

US 2017/0348577 A1 Dec. 7, 2017

(51) Int. Cl.
*A63B 69/00* (2006.01)
*A63B 69/20* (2006.01)

(52) U.S. Cl.
CPC ..... *A63B 69/208* (2013.01); *A63B 69/004* (2013.01); *A63B 69/20* (2013.01)

(58) Field of Classification Search
CPC ..... A63B 69/20; A63B 69/00; A63B 69/24; A63B 69/32; A63B 69/34; A63B 2240/10
See application file for complete search history.

(56) References Cited

U.S. PATENT DOCUMENTS 1,703,012 A * 2/1929 McNamara ..... A63B 69/208 482/90
3,724,845 A * 4/1973 Irby ..... A63B 69/205 273/DIG. 30
4,491,315 A * 1/1985 Dye ..... A63B 69/201 473/442
4,681,318 A * 7/1987 Lay ..... A63B 69/0091 473/423
4,817,941 A * 4/1989 McCorry ..... A63B 69/004 482/87
4,903,966 A * 2/1990 Liao ..... A63B 69/0091 473/423
5,324,227 A * 6/1994 Yuh-Ching ..... A63H 33/009 446/473
5,330,403 A * 7/1994 Kuo ..... A63B 69/208 482/83
5,478,070 A * 12/1995 Morrison ..... A63B 69/0075 473/419
5,722,920 A * 3/1998 Bauer ..... A63B 69/004 482/83
5,788,612 A * 8/1998 Rennick ..... A63B 69/208 482/83
5,792,032 A * 8/1998 Williams ..... A63B 69/34 482/83
6,027,435 A * 2/2000 Nadorf ..... A63B 69/208 482/146

(Continued)

*Primary Examiner* — Garrett K Atkinson
(74) *Attorney, Agent, or Firm* — Muncy, Geissler, Olds & Lowe, P.C.

(57) ABSTRACT

A striking training device is provided, including: a support body, having a seat end and an assembling end which are located along a first direction, the assembling end including an assembling mechanism; a hit mechanism, including a first hit member and at least one second hit member, the first hit member including a first mounting structure, each said second hit member including a second mounting structure, the first mounting structure being detachably assembled with the assembling mechanism positionably, each said second hit member being pivoted to the assembling structure via the second mounting structure so that the second hit member being rotatable laterally relative to the first direction. Both or one of the first hit member and the at least one second hit member are/is optionally assembled with the assembling structure.

9 Claims, 7 Drawing Sheets

(56) References Cited

U.S. PATENT DOCUMENTS 6,036,602 A * 3/2000 Abbott ..... A63B 69/004 463/47.2
6,080,089 A * 6/2000 Nicholson ..... A63B 69/208 248/519
6,390,958 B1 * 5/2002 Chu ..... A63B 69/20 482/83
6,398,697 B1 * 6/2002 Nichols, Jr. ..... A63B 69/20 473/441
6,679,795 B2 * 1/2004 Ouimette ..... A63B 63/06 280/47.24
6,893,384 B2 * 5/2005 Triani ..... A63B 69/208 482/83
7,357,760 B1 * 4/2008 Rios ..... A63B 69/004 473/444
7,651,447 B2 * 1/2010 Yang ..... A63B 69/0075 482/82
7,704,194 B1 * 4/2010 Chen ..... A63B 69/208 482/83
7,914,423 B1 * 3/2011 Cogan ..... A63B 69/208 482/86
9,095,757 B2 * 8/2015 Corbett ..... A63B 69/208
9,227,127 B2 * 1/2016 Vince ..... A63B 69/004
9,744,420 B1 * 8/2017 Bergamini ..... A63B 69/004
9,839,827 B1 * 12/2017 Roberts ..... A63B 23/12
2002/0183141 A1 * 12/2002 Ouimette ..... A63B 63/06 473/454
2003/0054904 A1 * 3/2003 Getchell ..... A63B 69/0024 473/446
2005/0209066 A1 * 9/2005 Penney ..... A63B 69/004 482/84
2006/0025284 A1 * 2/2006 Livingstone ..... A63B 69/004 482/83
2006/0089242 A1 * 4/2006 Boland ..... A63B 21/00047 482/142
2007/0167297 A1 * 7/2007 Stevenson ..... A63B 69/004 482/83
2012/0149534 A1 * 6/2012 Fu ..... A63B 69/004 482/90
2013/0109541 A1 * 5/2013 Fu ..... A63B 69/208 482/90
2013/0324372 A1 * 12/2013 Cuadrado ..... A63B 69/20 482/90
2014/0302969 A1 * 10/2014 Chen ..... A63B 69/203 482/90

* cited by examiner

STRIKING TRAINING DEVICE

BACKGROUND OF THE INVENTION

Field of the Invention

The present invention relates to a training device, and more particularly to a striking training device.

Description of the Prior Art

Conventionally, a striking training device has a target for a user to practice striking skills.

However, the conventional striking training device only has one target, or the target is fixedly arranged thereon, so the target cannot be disassembled to be assembled in various configurations in accordance with different requirements. The user usually needs to purchase different kinds of striking training devices to meet different needs, and it is time-consuming to purchase the striking training devices and space-wasting to put the striking training devices.

The present invention has arisen to mitigate and/or obviate the afore-described disadvantages.

SUMMARY OF THE INVENTION

The major object of the present invention is to provide a striking training device which has a plurality of hit members, one or more than one of the hit members can be optionally assembled at the same time, and the striking training device can be used in various configurations for various training needs.

To achieve the above and other objects, a striking training device is provided, including: a support body, having a seat end and an assembling end which are located along a first direction, the assembling end including an assembling mechanism; a hit mechanism, including a first hit member and at least one second hit member, the first hit member including a first mounting structure, each said second hit member including a second mounting structure, the first mounting structure being detachably assembled with the assembling mechanism positionably, each said second hit member being pivoted to the assembling structure via the second mounting structure so that the second hit member being rotatable laterally relative to the first direction, both or one of the first hit member and the at least one second hit member being optionally assembled with the assembling structure.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
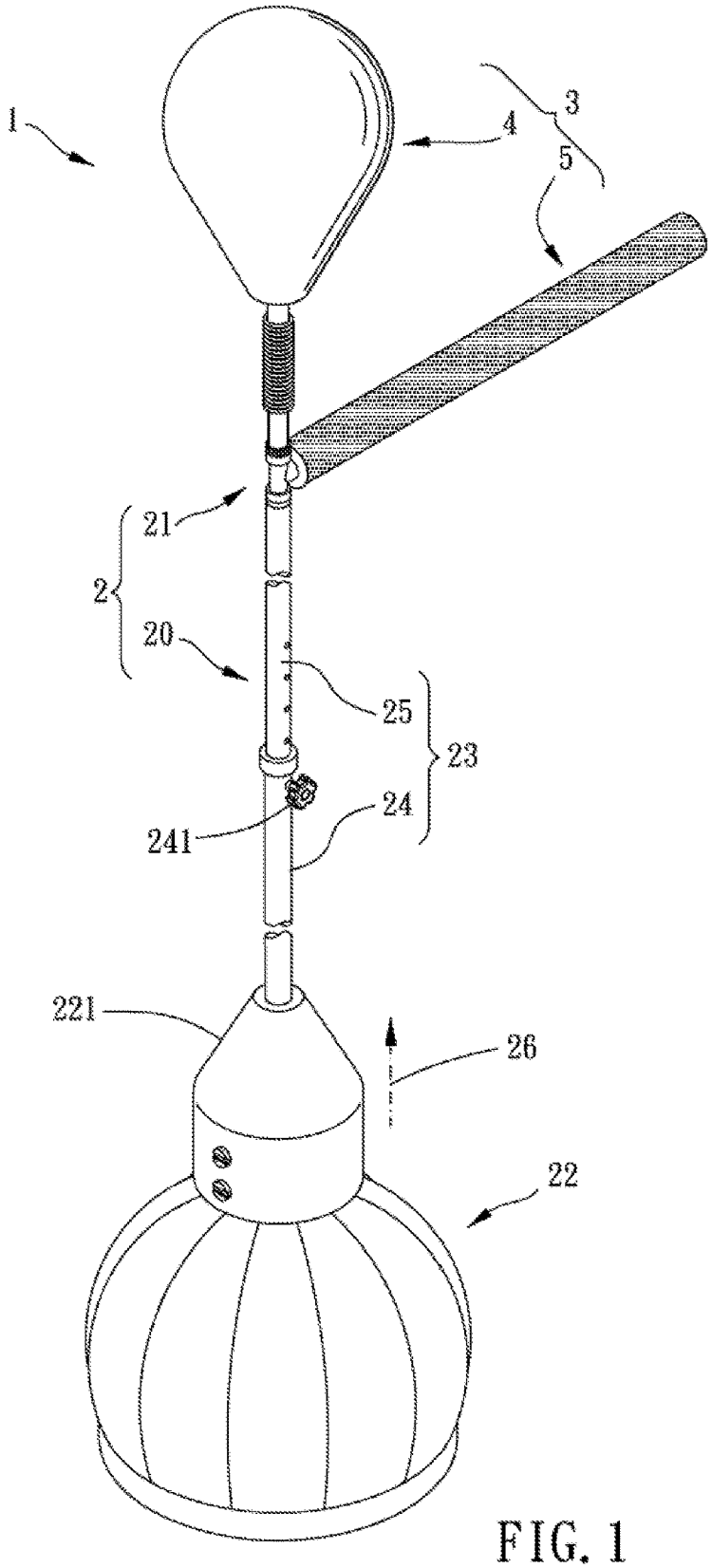
FIG. 1 is a stereogram of a first embodiment of the present invention.
Figures 2, 3:
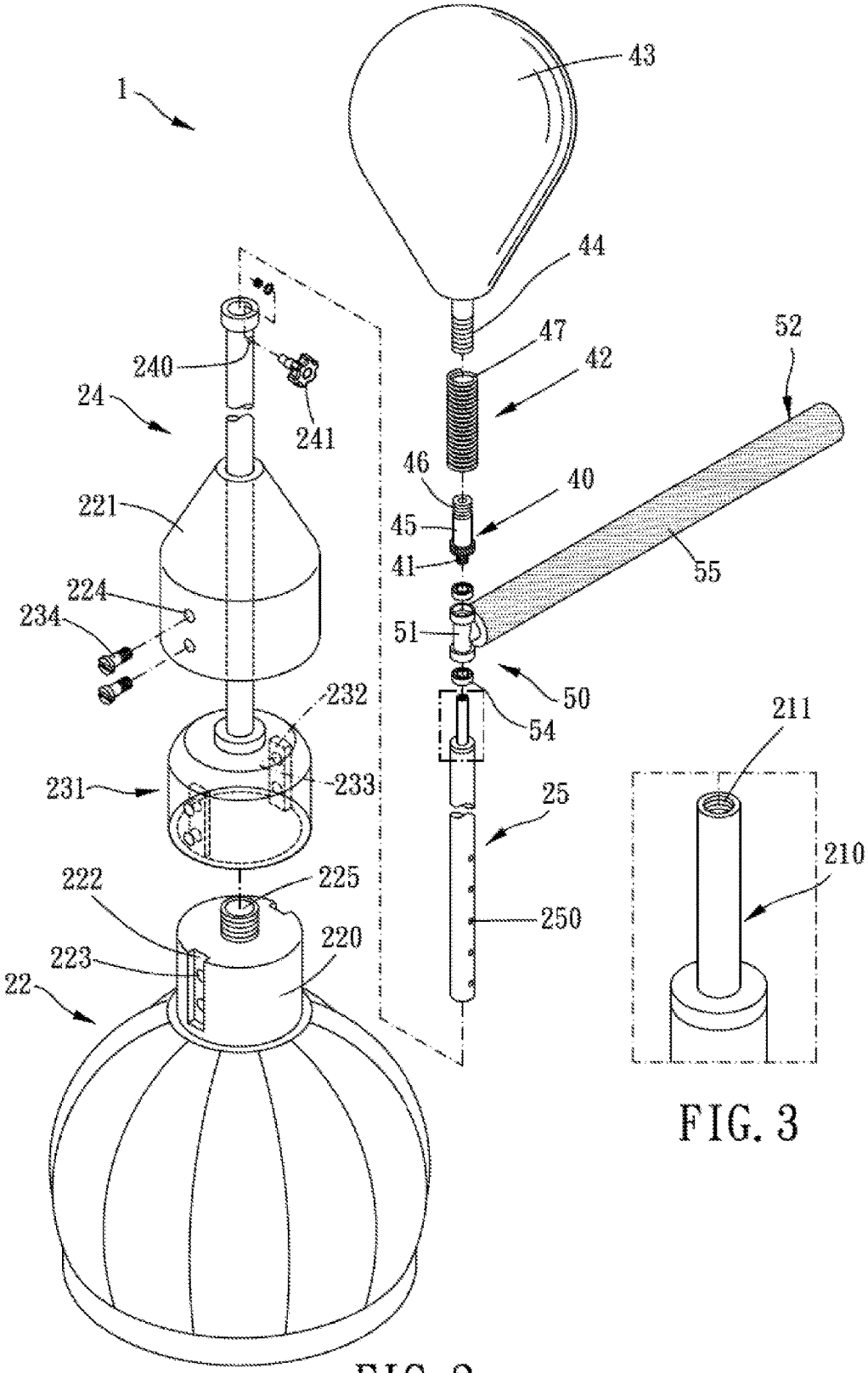
FIG. 2 is a breakdown view of the first embodiment of the present invention.
FIG. 3 is a partially-enlarged view of FIG. 2.
Figure 4:
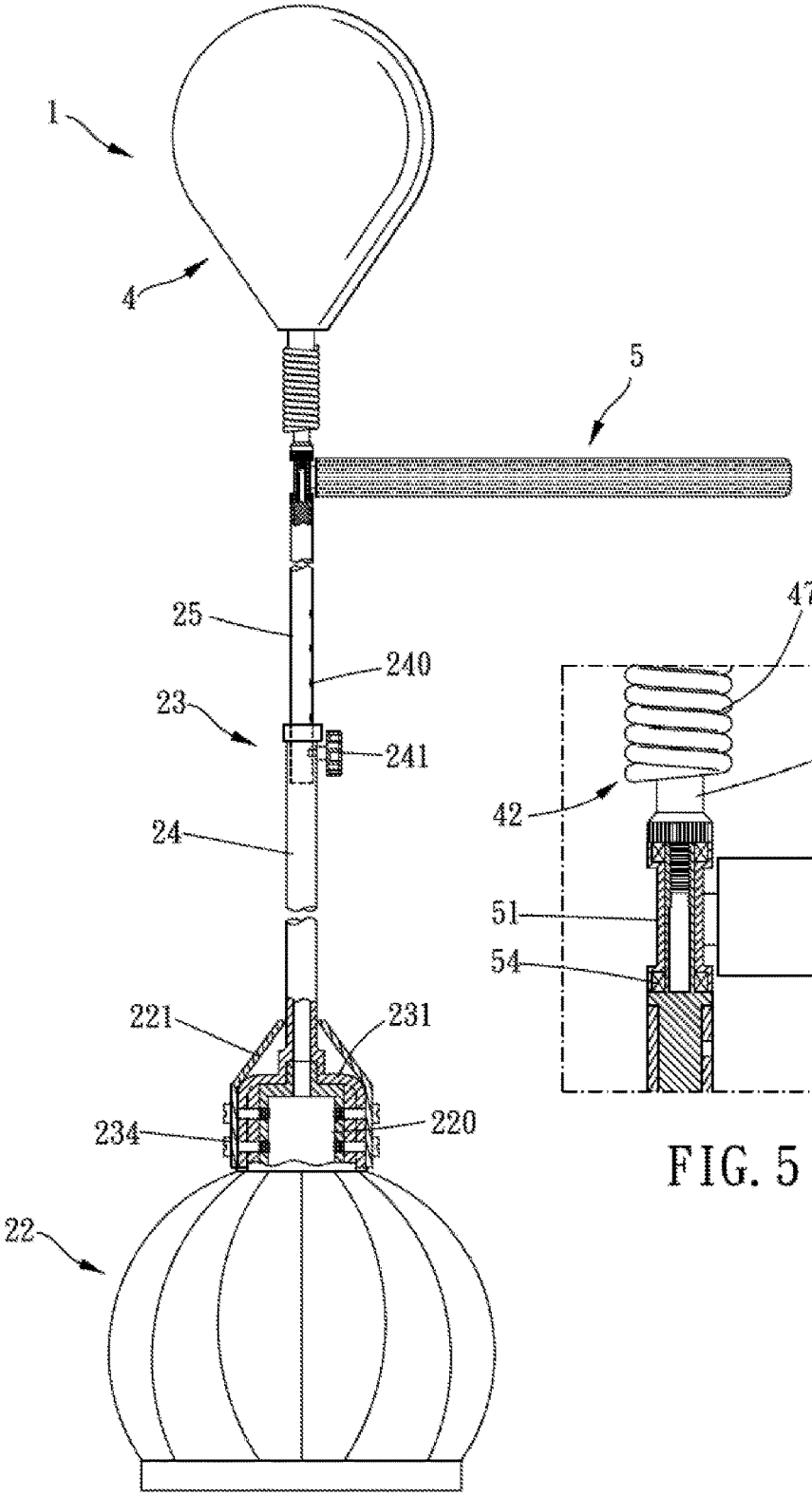
FIG. 4 is a partial cross-sectional view of the first embodiment of the present invention.
Figure 5:
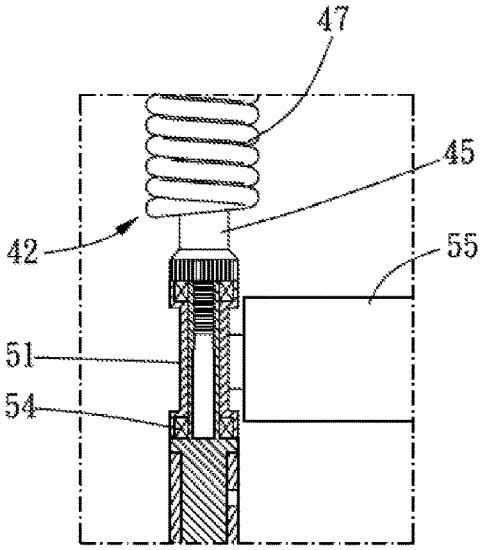
FIG. 5 is a partially-enlarged view of FIG. 4.

The present invention will be clearer from the following description when viewed together with the accompanying drawings, which show, for purpose of illustrations only, the preferred embodiment in accordance with the present invention.

Please refer to FIGS. 1 to 9 for a first embodiment of the present invention. A striking training device 1 includes a support body 2 and a hit mechanism 3.

The support body 2 has a seat end 20 and an assembling end 21 which are located along a first direction 26, and the assembling end 21 includes an assembling mechanism 210. The hit mechanism 3 includes a first hit member 4 and at least one second hit member 5, the first hit member 4 includes a first mounting structure 40, each said second hit member 5 includes a second mounting structure 50, the first mounting structure 40 is detachably assembled with the assembling mechanism 210 positionably, and each said second hit member 5 is pivoted to the assembling structure 210 via the second mounting structure 50 so that the second hit member 5 is rotatable laterally relative to the first direction 26. Both or one of the first hit member 4 and the at least one second hit member 5 are/is optionally assembled with the assembling structure 210 so that the striking training device 1 has three application configurations for various needs.

In this embodiment, the assembling structure 210 has a first threaded section 211, the first mounting structure 40 has a second threaded section 41 screwed with the first threaded section 211, one of the first threaded section 211 and the second threaded section 41 has an interior threaded portion, and the other of the first threaded section 211 and the second threaded section 41 has an exterior threaded portion so that the first hit member 4 can be stably screwed to the support body 2. The first hit member 4 includes a connecting body portion 42 and a first hit portion 43 disposed on one of two ends of the connecting body portion 42, and the first mounting structure 40 is disposed on the other of the two ends of the connecting body portion 42. The connecting body portion 42 includes a rod body 45 and a spiral spring 47, the rod body 45 has the first mounting structure 40 and a first exterior threaded section 46, the first hit portion 43 extends to form a second exterior threaded section 44, the spiral spring 47 is screwed with the first and second exterior threaded sections 46, 44 respectively, and the spiral spring 47 allows rock of the first hit member 4 and buffers the first hit member 4. The second mounting structure 50 includes a barrel body 51 pivotally disposed around the assembling structure 210 and a second hit portion 52 connected to the barrel body 51 laterally, the second hit portion 52 is surrounded by a wrapping member 55, and the wrapping member 55 has a buffering function so as to prevent the user from being hurt. At least one bearing 54 is further disposed between the barrel body 51 and the assembling structure 210, and the at least one bearing 54 allows the second hit member 5 to rotate laterally relative to the first direction 26 more smoothly.

The support body 2 includes a base 22 and a support rod 23, the base 22 includes an engaging seat 220, the engaging seat 220 has at least one longitudinal groove 222 recessed on a circumference thereof, a bottom of the longitudinal groove 222 has at least one hole portion 223, two ends of the support rod 23 are respectively provided with the assembling structure 210 and a sleeve portion 231, an inner wall of the sleeve portion 231 has at least one longitudinal engaging protrusion 232 arranged longitudinally thereon and at least one penetrating hole 233 which is lateral to the inner wall and corresponds to the at least one longitudinal engaging protrusion 232, the sleeve portion 231 is sleeved on the engaging seat 220, the at least one longitudinal engaging protrusion 232 is restrictedly engaged within the at least one longitudinal groove 222 for making the sleeve portion 223 and the engaging seat 220 engaged with each other positionably, and the at least one penetrating hole 233 corresponds to the at least one hole portion 223 and is fixed by at least one fastening member 234 disposed therethrough so that the support rod 23 and the base 22 can be engaged with each other stably. The striking training device 1 further includes a cover body 221, the support rod 23 is disposed through the cover body 221, the cover body 221 has at least one pass hole 224 which corresponds to the at least one penetrating hole 223, the cover body 221 is sleeved on the sleeve portion 231 and fixed by the at least one fastening member 234 disposed therethrough, and the cover body 221 can stabilize the support rod 23 and make the striking training device 1 more appearing. The engaging seat 220 further has an exterior threaded column 225, and the exterior threaded column 225 allows the base 22 to be engaged with a support rod 23, for example (but not limited thereto), the support rod 23 can be directly screwed with the exterior threaded column 225 so that the support rod 23 and the base 22 can be fixed without additional bolts.

The support body 23 includes a first support rod 24 and a second support rod 25 which are retractably axially connected with each other, the first support rod 24 has at least one first through hole 240 and the sleeve portion 231, the second support rod 25 has a plurality of second through holes 250 and the assembling structure 210, and a resilient positioning mechanism 241 is positionably disposed through one of the first through holes 240 and resiliently engaged within one of the second through holes 250 so that the user can choose to make one of the second through holes 250 correspond to the at least one first through hole 240 and positionably adjust a length of the support rod 23 via the resilient positioning mechanism 241.

The striking training device 1 further includes a lid member 6, when the at least one second hit member 5 is pivoted to the assembling structure 210 singularly, the lid member 6 is detachably assembled to a top of the assembling structure 210 to block the second mounting structure 50 on the first direction 26 so as to prevent each said second hit member 5 from falling off when in use.

Figure 6:
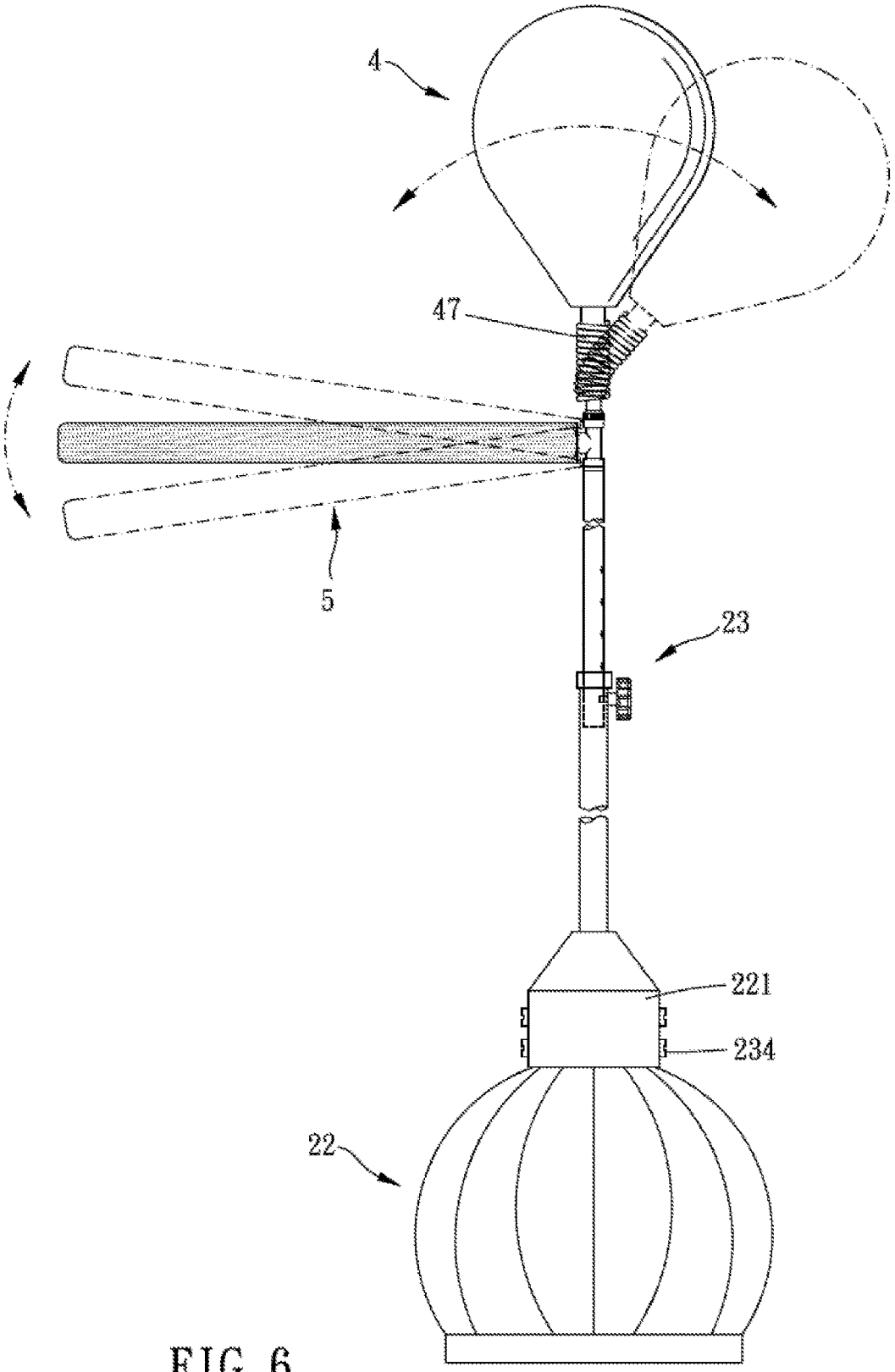
FIGS. 6 to 8 are drawings showing the first embodiment of the present invention in different configurations.
Figure 7:
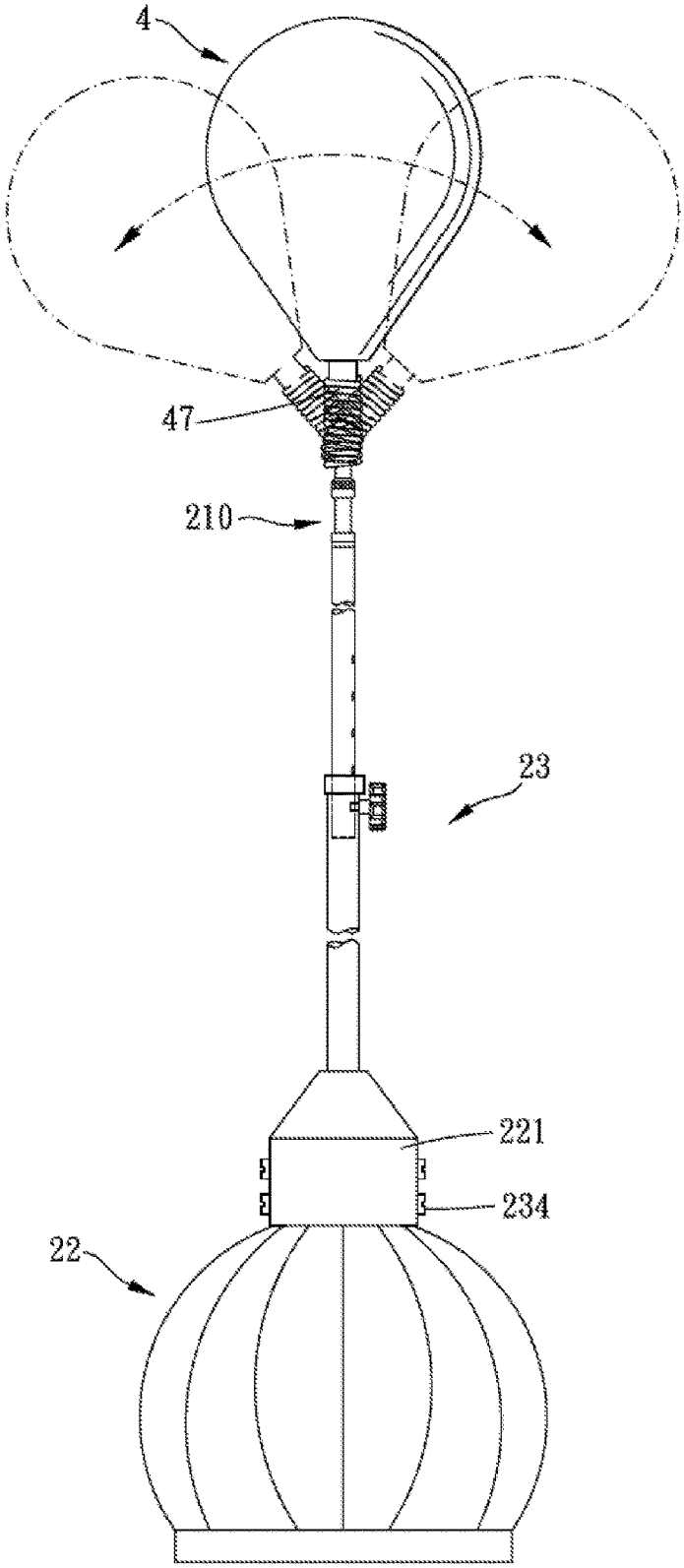
Figures 8, 9:
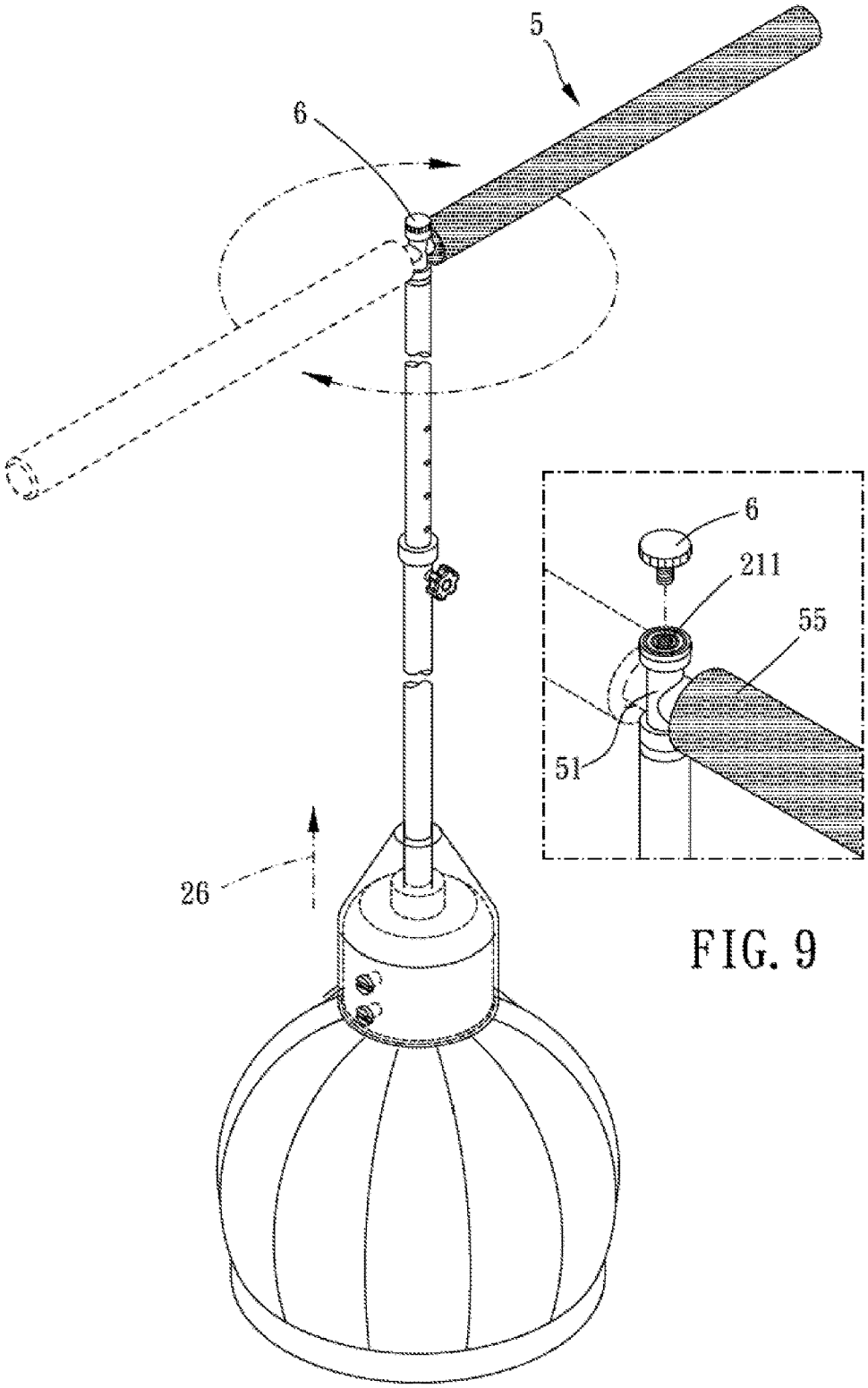
FIG. 9 is a partially-enlarged view of FIG. 8.

In actual practice, both of the first and second hit members 4, 5 can be assembled to the striking training device 1 at the same time (as shown in FIG. 6), the first hit member 4 can be assembled to the striking training device 1 singularly (as shown in FIG. 7), or the second hit member 5 can be assembled to the striking training device 1 singularly (as shown in FIG. 8). The first mounting mechanism 40 and each said second mounting mechanism 50 respectively have specifications corresponding to the assembling structure 210; therefore, the first and second hit members 4, 5 can be quickly and easily assembled to the striking training device 1 without other connecting mechanisms.

Figure 10:
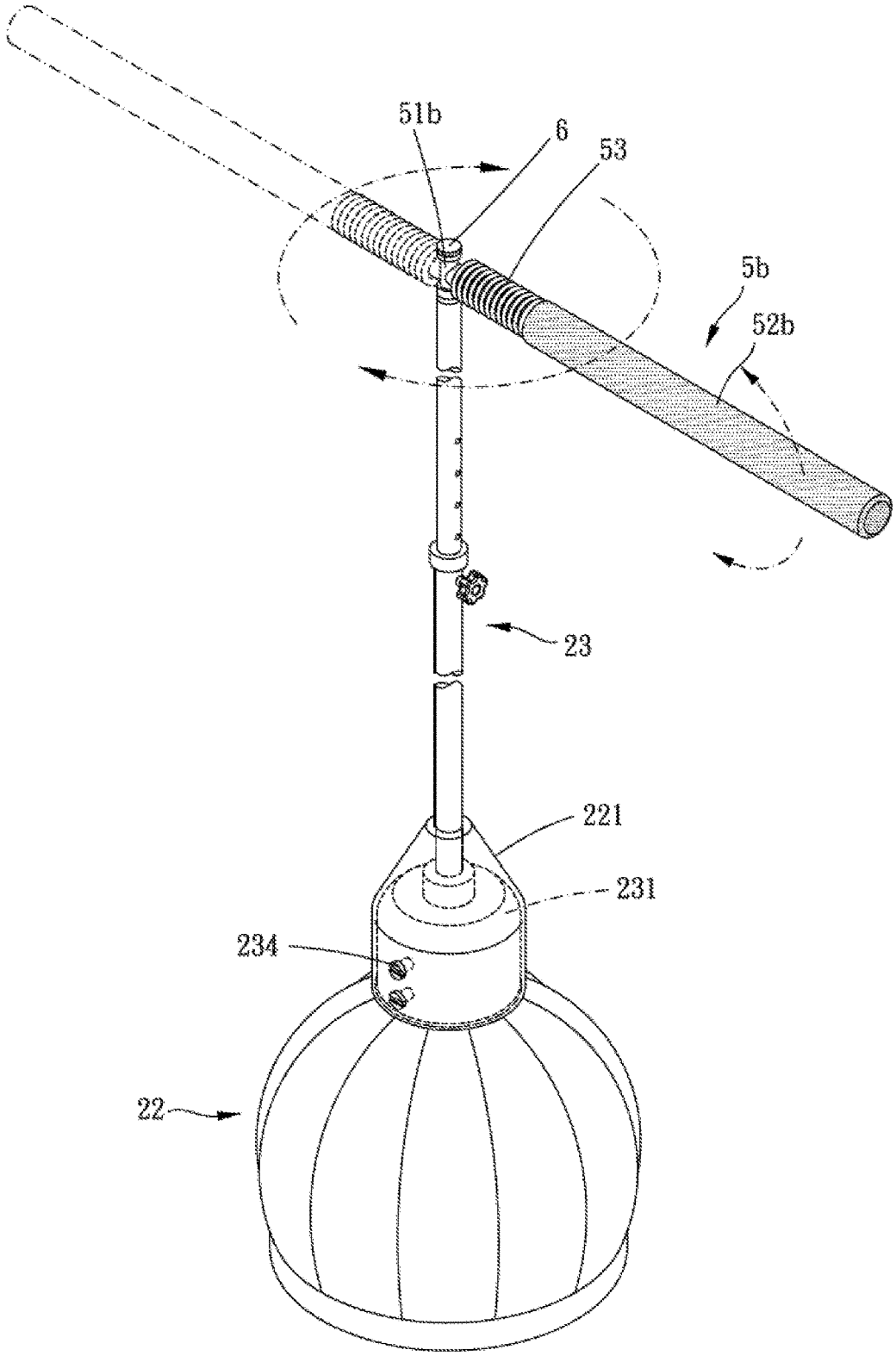
FIG. 10 is a drawing showing another preferred embodiment of the present invention in use.

Please refer to FIG. 10 for another embodiment, the barrel body 51*b* and the second hit portion 52*b* are connected by an elastic member 53, and the elastic member 53 allows rock of the second hit member 5*b* and buffers the second hit member 5*b*.

In other embodiments, the spiral spring of the first hit member may be in other configurations, for example, a flexible tube (but not limited thereto); or the spiral spring may not be provided, and the rod body is flexible so that the first hit member can rock when being hit. The second support rod may have the at least one first through hole, and the first support rod may have the plurality of second through holes as long as one of the first and second support rods has the at least one first through hole, the other of the first and second support rods has the plurality of second through holes, and the resilient positioning mechanism is positionably disposed through one of the first through holes and resiliently engaged within one of the second through holes. The first support rod and the second support rod may be connected with each other in other configurations, for example (but not limited thereto), a concave-convex structure which can be engaged with each other as long as the length of the support rod is adjustable. The striking training device may be provided without the cover body or the exterior threaded column. The first hit member or/and the second hit member can be connected to the assembling structure in other ways as long as the first and second hit members are detachably and positionably assembled to the assembling structure.

Give the above, in the striking training device, both or one of the first and second hit members can be optionally assembled to the striking training device to meet various training needs.

While we have shown and described various embodiments in accordance with the present invention, it should be clear to those skilled in the art that further embodiments may be made without departing from the scope of the present invention.

What is claimed is:

1. A striking training device, including:

a support body, having a seat end and an assembling end which are located along a first direction, the assembling end including an assembling structure;

a hit mechanism, including a first hit member and at least one second hit member, the first hit member including a first mounting structure, each said second hit member including a second mounting structure, the first mounting structure being detachably assembled with the assembling structure positionably, each said second hit member being pivoted to the assembling structure via the second mounting structure so that the second hit member being rotatable laterally relative to the first direction, both or one of the first hit member and the at least one second hit member being optionally assembled with the assembling structure;

wherein the first hit member includes a connecting body portion and a first hit portion disposed on one of two ends of the connecting body portion, and the first mounting structure is disposed on the other of the two ends of the connecting body portion;

wherein the connecting body portion includes a rod body and an elastic member, the rod body has the first mounting structure, and the elastic member is connected with the rod body;

wherein the second mounting structure is normally rotatably supported on the assembling structure and normally freely rotatable relative to the assembling structure and the connecting body portion.

2. The striking training device of claim 1, wherein the assembling structure has a first threaded section, the first mounting structure has a second threaded section screwed with the first threaded section, one of the first threaded section and the second threaded section has an interior threaded portion, and the other of the first threaded section and the second threaded section has an exterior threaded portion.

3. The striking training device of claim 1, wherein the elastic member is a spiral spring, the rod body further has a first exterior threaded section, the first hit portion includes a second exterior threaded section, and the spiral spring is screwed with the first and second exterior threaded sections respectively.

4. The striking training device of claim 3, wherein the second mounting structure includes a barrel body which is pivotally disposed around the assembling structure and a second hit portion which is laterally connected to the barrel body; the second hit portion is surrounded by a wrapping member; at least one bearing is further disposed between the barrel body and the assembling structure; the support body includes a base and a support rod, the base includes an engaging seat, the engaging seat has at least one longitudinal groove recessed on a circumference thereof, a bottom of the longitudinal groove has at least one hole portion, two ends of the support rod are respectively provided with the assembling structure and a sleeve portion, an inner wall of the sleeve portion has at least one longitudinal engaging protrusion arranged longitudinally thereon and at least one penetrating hole which is lateral to the inner wall and corresponds to the at least one longitudinal engaging protrusion, the sleeve portion is sleeved on the engaging seat, the at least one longitudinal engaging protrusion is restrictedly engaged within the at least one longitudinal groove, and the at least one penetrating hole corresponds to the at least one hole portion and is fixed by at least one fastening member disposed therethrough; the striking training device further includes a cover body, the support rod is disposed through the cover body, the cover body has at least one pass hole which corresponds to the at least one penetrating hole, the cover body is sleeved on the sleeve portion and fixed by the at least one fastening member disposed therethrough; the engaging seat further has an exterior threaded column; the support rod includes a first support rod and a second support rod which are retractably axially connected with each other, the first support rod has at least one first through hole and the sleeve portion, the second support rod has a plurality of second through holes and the assembling structure, and a resilient positioning mechanism is positionably disposed through one of the first through holes and resiliently engaged within one of the second through holes.

5. The striking training device of claim 1, wherein the second mounting structure includes a barrel body pivotally disposed around the assembling structure and a second hit portion connected to the barrel body laterally.

6. The striking training device of claim 5, wherein at least one bearing is further disposed between the barrel body and the assembling structure.

7. The striking training device of claim 1, wherein the support body includes a base and a support rod, the base includes an engaging seat, the engaging seat has at least one longitudinal groove recessed on a circumference thereof, a bottom of the longitudinal groove has at least one hole portion, two ends of the support rod are respectively provided with the assembling structure and a sleeve portion, an inner wall of the sleeve portion has at least one longitudinal engaging protrusion arranged longitudinally thereon and at least one penetrating hole which is lateral to the inner wall and corresponds to the at least one longitudinal engaging protrusion, the sleeve portion is sleeved on the engaging seat, the at least one longitudinal engaging protrusion is restrictedly engaged within the at least one longitudinal groove, and the at least one penetrating hole corresponds to the at least one hole portion and is fixed by at least one fastening member disposed therethrough.

8. The striking training device of claim 1, wherein the support body includes a first support rod and a second support rod which are retractably axially connected with each other, one of the first and second support rods has at least one first through hole, the other of the first and second support rods has a plurality of second through holes, and a resilient positioning mechanism is positionably disposed through one of the first through holes and resiliently engaged within one of the second through holes.

9. The striking training device of claim 1, further including a lid member, wherein when the at least one second hit member is pivoted to the assembling structure and the first hit member is detached from the assembling structure, the lid member is detachably assembled to a top of the assembling structure to block the second mounting structure on the first direction.

* * * * *